US006741441B2

(12) United States Patent
Hilbert et al.

(10) Patent No.: US 6,741,441 B2
(45) Date of Patent: May 25, 2004

(54) ELECTROMAGNETIC ACTUATOR SYSTEM AND METHOD FOR ENGINE VALVES

(75) Inventors: Harold Sean Hilbert, Canton, MI (US); Stephen James Newton, Ann Arbor, MI (US); Shawn Harold Swales, Canton, MI (US); Youqing Xiang, Canton, MI (US); Zeljko Popovic, Sterling Heights, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 272 days.

(21) Appl. No.: 10/076,010

(22) Filed: Feb. 14, 2002

(65) Prior Publication Data

US 2003/0150414 A1 Aug. 14, 2003

(51) Int. Cl.[7] ..... H01G 9/00

(52) U.S. Cl. ..... 361/160; 361/152; 361/154; 361/187

(58) Field of Search ..... 361/152–154, 361/159–160, 170, 187, 206; 123/90.11, 90.15

(56) References Cited

U.S. PATENT DOCUMENTS

| | | | |
|---|---|---|---|
| 4,266,261 | A | 5/1981 | Streit et al. |
| 4,942,851 | A | 7/1990 | Kawamura |
| 4,955,334 | A | 9/1990 | Kawamura |
| 5,095,856 | A | 3/1992 | Kawamura |
| 5,645,019 | A | 7/1997 | Liang et al. |
| 5,647,311 | A | 7/1997 | Liang et al. |
| 5,804,962 | A | 9/1998 | Kather et al. |
| 5,818,680 | A | 10/1998 | Schmitz et al. |
| 5,917,692 | A | 6/1999 | Schmitz et al. |
| 5,934,231 | A | 8/1999 | Schmitz et al. |
| 5,961,097 | A | 10/1999 | Zimmermann |
| 5,964,192 | A | 10/1999 | Ishii |
| 5,991,143 | A | 11/1999 | Wright et al. |
| 6,024,059 | A | 2/2000 | Kamimaru et al. |
| 6,044,814 | A | 4/2000 | Fuwa |
| 6,047,672 | A | 4/2000 | Hanai et al. |
| 6,066,999 | A | 5/2000 | Pischinger |
| 6,081,413 | A | 6/2000 | Schmitz et al. |
| 6,128,175 | A | 10/2000 | Wright et al. |
| 6,141,201 | A | 10/2000 | Schmitz |
| 6,152,094 | A | 11/2000 | Kirschbaum |
| 6,158,715 | A | 12/2000 | Kirschbaum |
| 6,173,684 | B1 | 1/2001 | Buehrle, II et al. |
| 6,176,207 | B1 | 1/2001 | Wright et al. |
| 6,176,209 | B1 | 1/2001 | Ishii |
| 6,196,172 | B1 | 3/2001 | Cosfeld et al. |
| 6,234,122 | B1 | 5/2001 | Kirschbaum et al. |
| 6,269,784 | B1 | 8/2001 | Newton |
| 6,285,151 | B1 | 9/2001 | Wright et al. |
| 6,292,345 | B1 | 9/2001 | Muller et al. |

FOREIGN PATENT DOCUMENTS

| | | |
|---|---|---|
| EP | 1049114 | 11/2000 |
| EP | 1164602 | 12/2001 |
| GB | 2380814 | 4/2003 |
| WO | WO 00/22283 | 4/2000 |
| WO | WO 01/81732 | 1/2001 |

*Primary Examiner*—Anthony Dinkins
(74) *Attorney, Agent, or Firm*—MacMillan, Sobanski & Todd LLC

(57) ABSTRACT

An apparatus and a method for electromagnetically actuating engine valves to obtain soft seating. The magnitude and duration of current pulses applied to the armature attracting coils are determined based upon a total mechanical energy and a total energy loss of the armature obtained from the armature position.

17 Claims, 7 Drawing Sheets

ELECTROMAGNETIC ACTUATOR SYSTEM AND METHOD FOR ENGINE VALVES

FIELD OF THE INVENTION

The present invention relates generally to systems for electromagnetically actuating engine valves. More specifically, it relates to the control of the actuator armature and engine valve with soft seating of actuator armature to actuator cores, and soft seating of engine valves.

BACKGROUND OF THE INVENTION

It has been well known that variable valve timing for internal combustion engines will improve their fuel economy and reduce emissions. An electromagnetic valve actuation system (EMVAS) is one of the technologies to realize the required variable valve timing.

One form of known electromechanical actuators includes an armature that moves back and forth along a linear travel path between two electromagnet cores. The armature functions as an actuating member and is operated against the force of two springs positioned on opposite sides of the armature. In an unactuated state, the armature is positioned midway between the two cores by the opposing springs.

Electromagnetic actuators of the above-described type are used, for example, for operating cylinder valves of internal combustion engines. Each cylinder valve is actuated by the armature of the associated electromagnetic actuator. The armature which, by virtue of the forces of the return springs, assumes its position of rest between the two electromagnets, is alternatingly attracted by the one or the other electromagnet, and, accordingly, the cylinder valve is maintained in its closed or open position.

A first problem associated with EMVAS's is to initialize the armature from a middle position to either a valve open position or a valve closed position with soft seating of the armature and the engine valve.

A second problem associated with EMVAS's is to control the armature transition from the open position to the closed position or from the closed position to the open position with soft seating between the armature cores and the armature, and between the valve and the engine head.

A third problem is the robustness of the soft seating initialization and transition control.

A fourth problem is the high-bandwidth and complicated current shaping requirement for achieving the required soft seating control.

A fifth problem is the power consumption minimization of the EMVAS and the power requirement reduction to minimize the system size, weight and cost.

A sixth problem is the power wasted every time the EMVAS and the valve train are shut down.

SUMMARY OF THE INVENTION

The present invention concerns an apparatus and method for operating an electromagnetic valve actuator coil in a manner to solve the above-described problems by using an energy feedback and loss compensation algorithm. The apparatus controls a valve actuator having an armature positioned between open and close coils. Included is a position processor that generates an energy signal and open and close timer signals in response to a position signal representing a position of the valve actuator armature relative to the open and close coils. A current controller generates a final current command signal and a normalized energy signal in response to the energy signal and an event generator generates event signals in response to the open and close timer signals and the normalized energy signal. A supervision logic controller generates initialization and transition signals in response to the final current command signal and the event signals, the initialization and transition signals defining current pulse magnitude and duration for soft seating of the armature on a seating surface of cores associated with the open and close coils.

The method for controlling includes the steps of: generating a final current command signal in response to a position signal representing a position of a valve actuator armature relative to open and close coils; generating a first signal in response to the final current command signal defining a higher magnitude current pulse of predetermined duration to draw the armature toward the one of the coils; generating a second signal in response to the final current command signal defining a predetermined period of no current pulse; and generating a third signal in response to the final current command signal defining a lower magnitude holding current pulse for soft seating of the armature on a seating surface of a core associated with the one coil.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figures 1A, 1B, 1C:
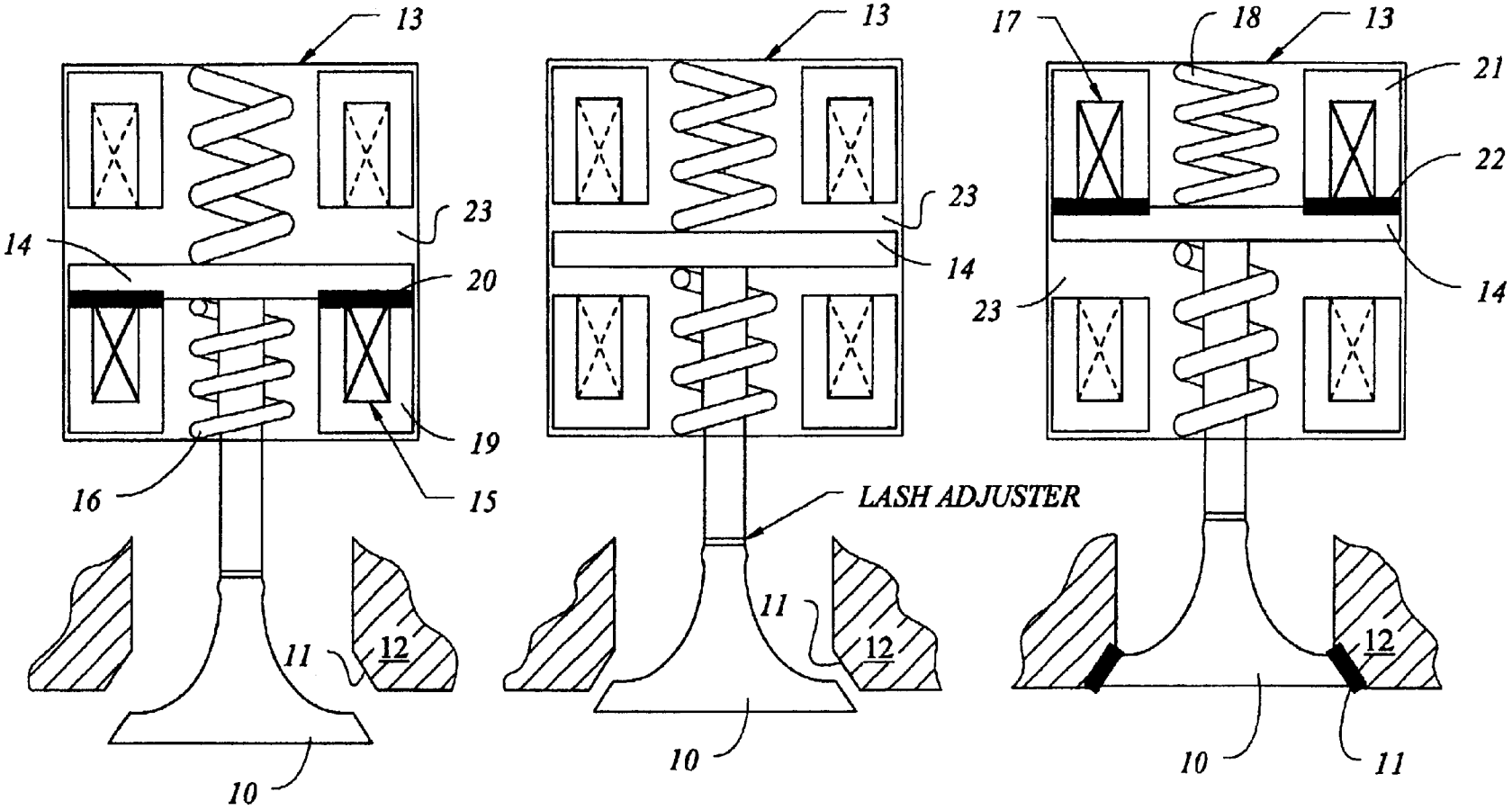
FIGS. 1*a*–1*c* are schematic views of an electromagnetic valve actuator system showing the valve open, valve half open and valve closed positions respectively.

FIGS. 1*a* through 1*c* show an engine valve 10 mounted for reciprocation in a port 11 of an engine part 12. An electromagnetic valve actuator 13 is controlled to operate the engine valve 10 to an opened position (FIG. 1*a*), a half opened position (FIG. 1*b*), or a closed position (FIG. 1*c* according to commands from an engine controller (not shown). The actuator 13 includes an armature 14 attached to the stem of the valve 11. The armature 14 is attracted by an energized lower coil 15 to compress a lower spring 16 as shown in FIG. 1*a*. Alternatively, the armature 14 is attracted by an energized upper coil 17 to compress an upper spring 18 as shown in FIG. 1*c*.

The lower coil 15 and the lower spring 16 are retained in a lower core 19 having an upwardly facing seating surface 20 against which the armature 14 comes to rest in the valve opened position. The upper coil 17 and the upper spring 18 are retained in an upper core 21 having an downwardly facing seating surface 22 against which the armature 14 comes to rest in the valve closed position. The seating surfaces 20 and 22 are spaced apart by a gap 23 through which the armature 14 passes in transition and in which the armature is centered when both of the coils 15 and 17 are not energized.

Figure 2:
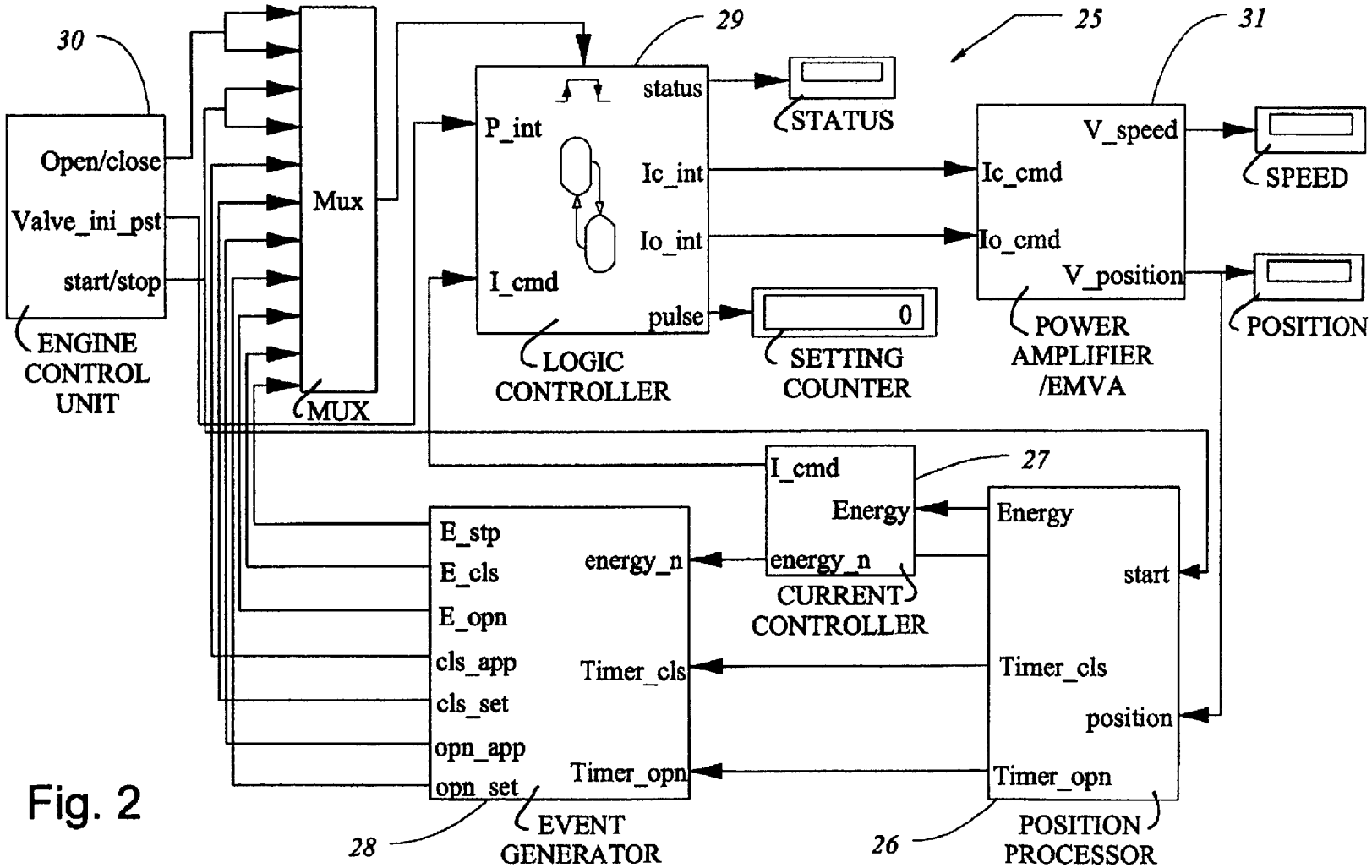
FIG. 2 is a schematic block diagram of the energy-feedback loss-compensation control circuit of the electromagnetic valve actuator system according to the present invention.

FIG.2 is a block diagram of an energy-feedback loss-compensation control circuit 25 according to the present invention. The circuit 25 includes four major functional blocks: 1) a position processor 26; 2) a current controller 27; 3) an event generator 28; and 4) a supervision logic controller 29. An engine control unit 30 generates commands, such as open/close transition (Open/close), start/stop operation (start/stop), and first valve position for initialization (Valve_ini_pst), at outputs connected to inputs to the controller 25. The controller 25 responds to these commands and generates current commands to a current regulated power amplifier 31 that drives the coils 15 and 17 for valve motion actuation.

Figure 3:
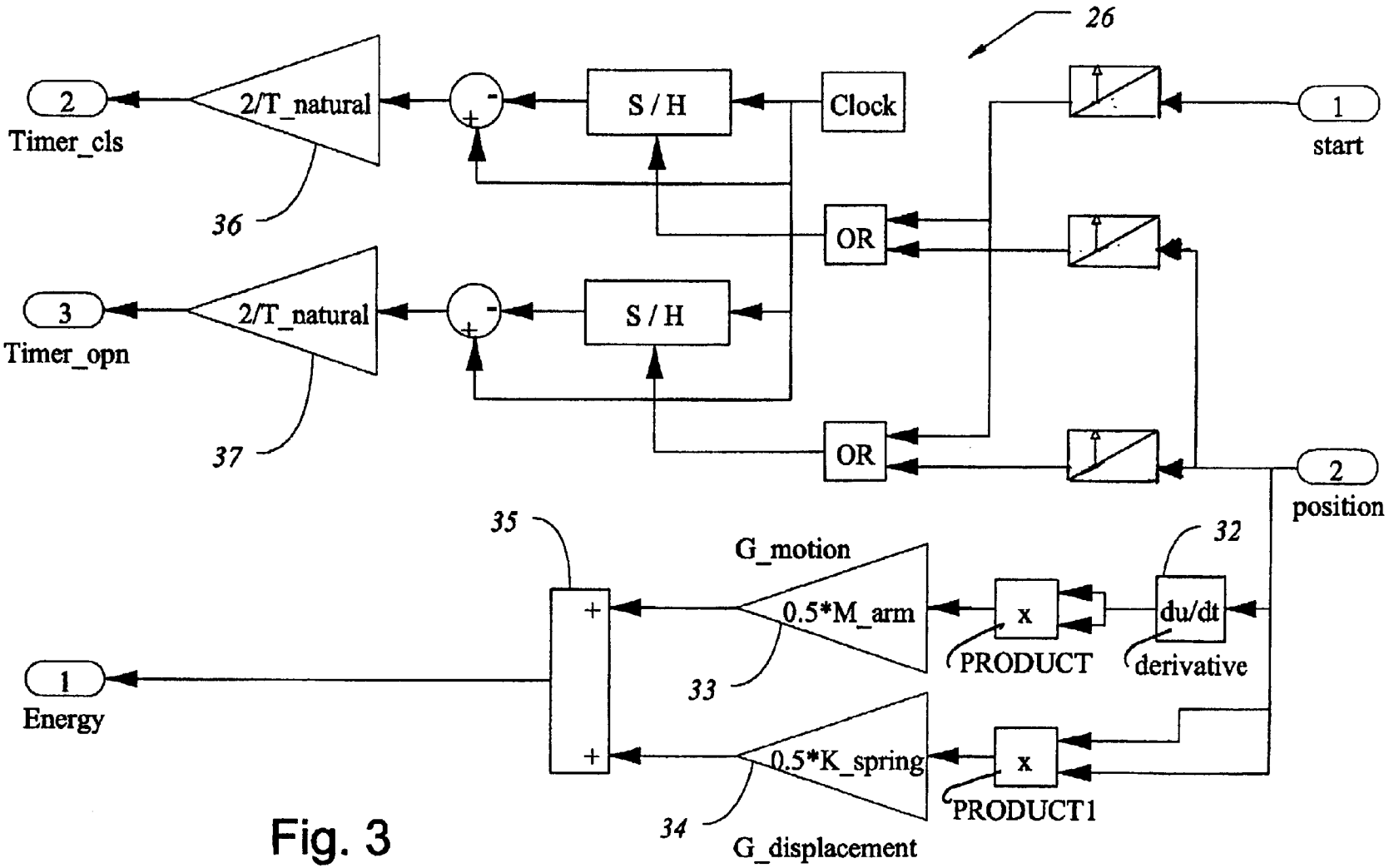
FIG. 3 is a schematic block diagram of the position processor shown in FIG. 2.

FIG.3 shows the signal flow for position information processing in the position processor 26. A start signal, at an input terminal 1, begins the process. First, the position signal, at an input terminal 2, is differentiated (32) to obtain the speed of the armature 14. The speed and the position of the armature 14 are converted to mechanical energy values (33 and 34) that are summed (35) to obtain the total mechanical energy of the armature generated as an Energy signal at an output terminal 1. Secondly, the zero-crossing point of the position signal is generated to trigger a counter for the closing process and the opening process, respectively. Half of the natural transition time (36 and 37) is used to normalize a pair of timers generating a Timer_cls signal at an output terminal 2 and a Timer_opn signal at an output terminal 3. Note that this information can also be obtained through the direct measurement of armature acceleration. This signal can then be integrated to obtain the velocity and the position of the armature 14.

Figure 4:
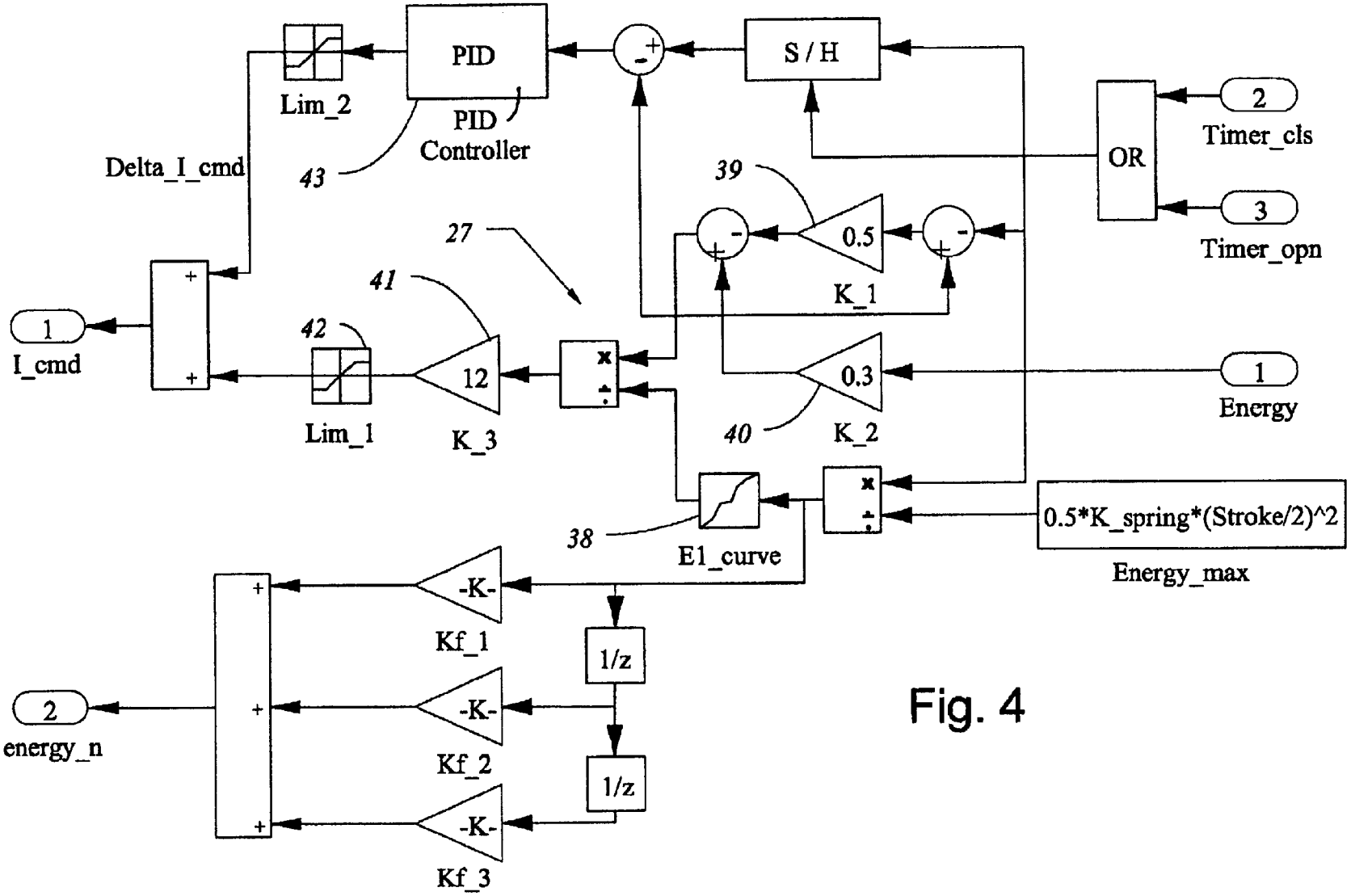
FIG. 4 is a schematic block diagram of the current controller shown in FIG. 2.

FIG.4 shows the energy-feedback based current controller 27. The Energy signal from the position processor 26 is received at an input terminal 1 and is first normalized based on the maximum potential energy. A look-up table 38 named EI_curve determines the amount of energy that can be injected into the armature 14 by a current pulse with a magnitude of I_max (here I_max=12 A). On the other hand, a total loss is estimated based on the status of the armature 14 (in terms of energy) and two gains (K_1 at 39 and K_2 at 40). There are other mechanisms to estimate this total loss, even including the aerodynamic loss. The total loss is compared with the maximum available energy injection (38) and a final current command I_cmd is obtained at an output terminal 1 after scaling (K-3 at 41) and processing by a limiter (42).

Figure 5:
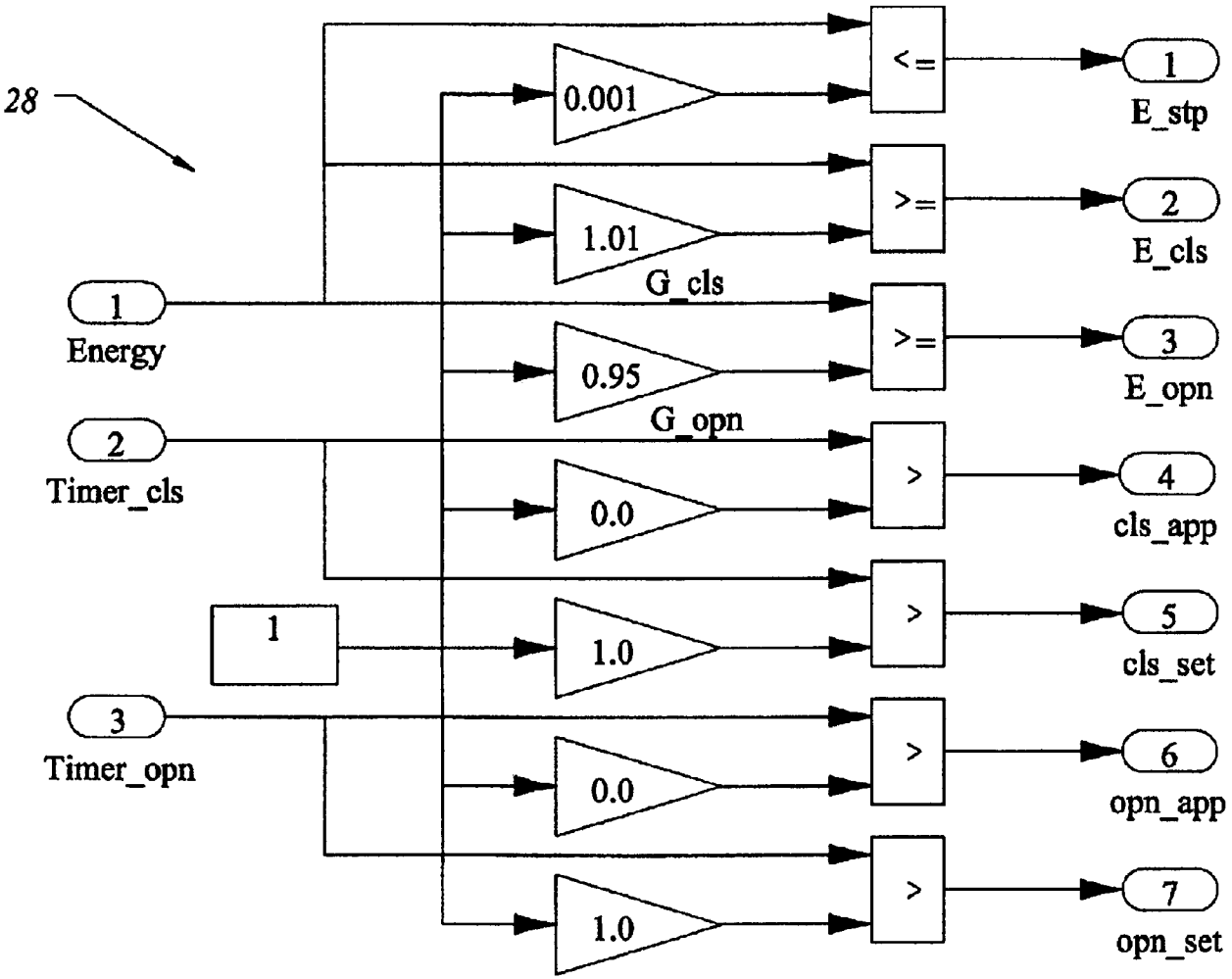
FIG. 5 is a schematic block diagram of the event generator shown in FIG. 2.
Figure 6:
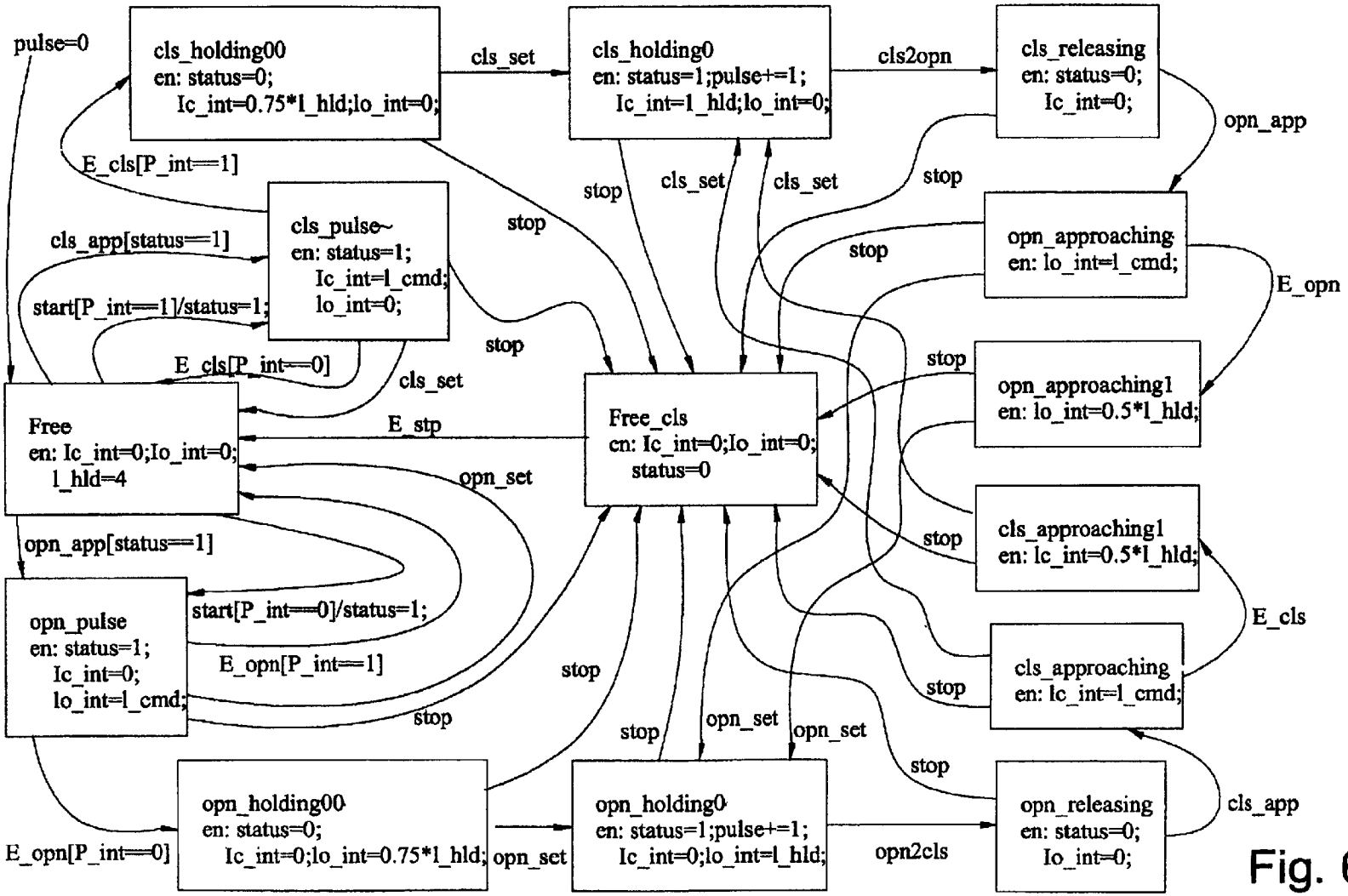
FIG. 6 is a schematic block diagram of the logic controller shown in FIG. 2.

FIG. 5 shows the event generator 28 that is used to trigger the supervision logic controller 29 as shown in FIG. 6. Based on the Timer_cls signal received at an input terminal 2 from the position processor 26, a cls_app signal is generated at an output terminal 4 when armature 14 is released from the open position and approaches to the closed position when passing the middle point in the gap 23. This cls_app signal is used to start the current pulse that will be terminated when a cls_set signal is available. The same operation is performed for the closed-to-open transition based on Timer_opn received at an input terminal 3 from the position processor 26. Another way to terminate the current pulse is to use an events signal E_cls generated at an output terminal 2 and an events signal E_opn generated at an output terminal 3 which signals indicate that the armature reached enough energy status for seating. An event signal E_stp is generated at an output terminal 1 for stopping the armature 14. These three energy feedback related events (E_opn, E_cls and E_stp) are generated based on a normalized energy signal energy_n generated from an output terminal 2 of the current controller 27 and received at an input terminal 1.

Figure 7:
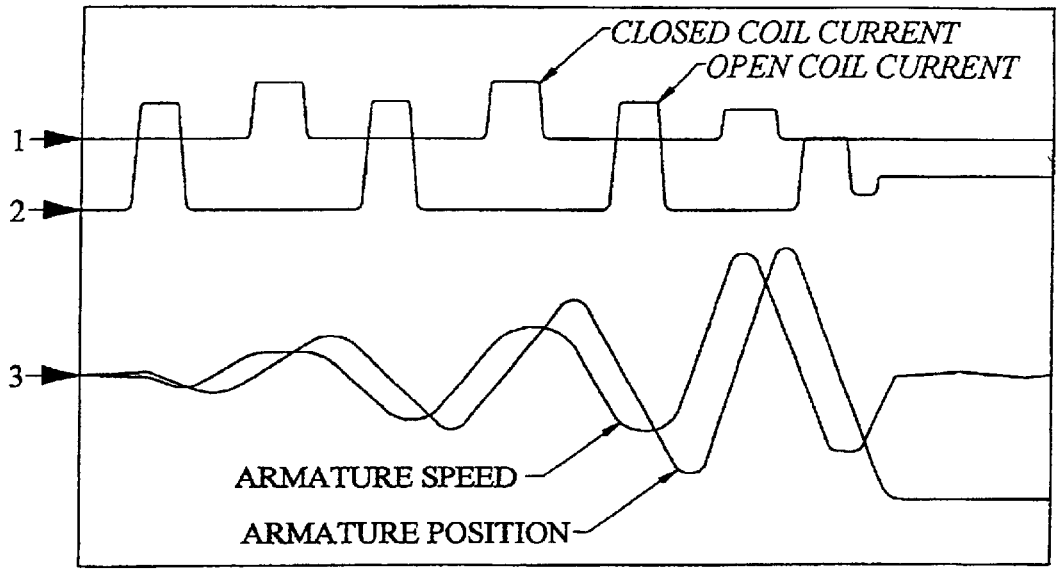
FIG. 7 is a waveform plot of coil current, armature speed and armature position during an initialization process of the electromagnetic valve actuator system shown in FIG. 2.

FIG. 6 shows the supervision logic controller 29 that consists of two major parts: Initialization and Transition. When a "start" command appears, the state transits from "Free" to either "cls_pulse" or "opn_pulse" depending on the P_int=l or P_int=O, respectively. In these states, Ic_int and Io-int are the current commands sent to the close coil 17 and the open coil 15, respectively. The cls_set or the opn_set event will terminate the current pulse. After a short period of free running, the opn_app or the cls_app event will trigger another current pulse. After certain current pulses and if the armature energy is enough, the state will transit to cls_holding00 or opn_holding00 depending on the value of P_int. It is important to note that the commanding currents in these two states (opn_pulse and cls_pulse) have been reduced to just overcome the friction for soft seating. Then, the cls_set or the opn_set events will transit the state to cls_holding0 or opn_holding0 with the total required holding current predetermined experimentally. This is the initialization process, which is shown in FIG. 7. It needs to be noted that the magnitudes of the current pulses are reduced for the purpose of soft seating.

Figure 8:
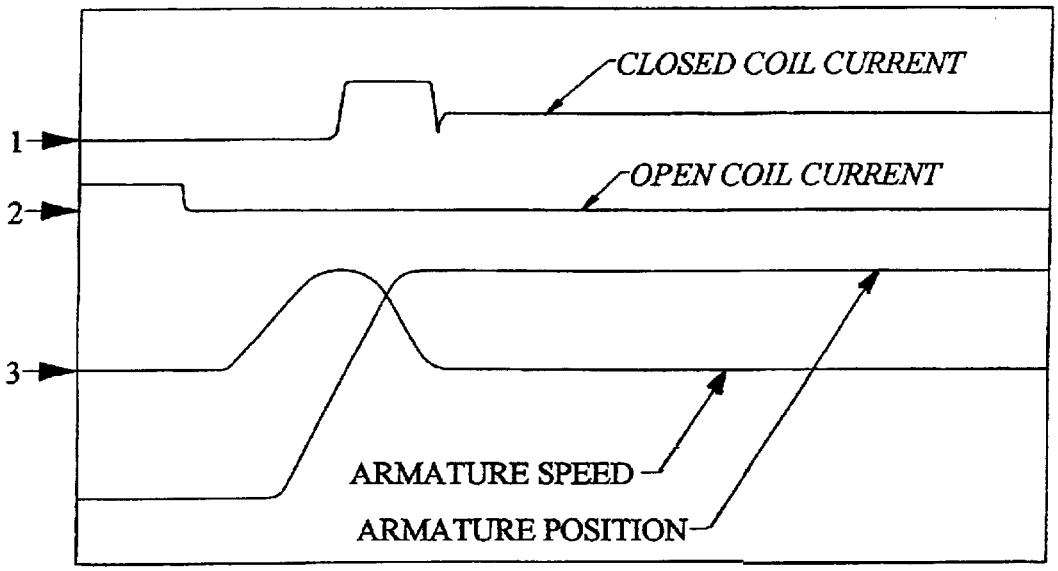
FIG. 8 is a waveform plot of coil current, armature speed and armature position during an open-to-closed transition control process of the electromagnetic valve actuator system shown in FIG. 2.

Referring to FIG. 6 and FIG. 8, the transition process is triggered by the event opn2cls or the event cls2opn. FIG. 8 shows the transition control process from open to close. On the event of opn2cls, the open coil current is cut off and the armature is moving towards the close coil 17 driven by the spring force and after a mechanical response time (about 2.5 ms). When the armature passes through the middle point, the csl_app event is generated to start the current pulse in the close coil 17. When the energy reaches the preset level, the current is reduced until the cls_set event appears. This event will change the command current to the holding current until the cls2opn event is generated.

Referring to FIG. 4, the current command I_cmd can be added to by a difference component delt_I_cmd, which is determined by the armature energy when it seats. If the seating energy is larger than the full system energy, a negative delt_I_cmd signal will be generated. On the other side, a positive delt_I_cmd signal will be generated if the seating energy is smaller than the full system energy. A PI regulator 43 can be used to implement this feature. By doing this, the control robustness will be enhanced.

Referring to FIG. 7 and considering the stopping process, the energy stored in the compressed spring will be regenerated back to the battery by applying the current pulses with a 180 degree phase shift relative to armature position (taking one cycle of armature natural oscillation as 360 degrees.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for controlling an electromagnetic valve actuator having an armature positioned between open and close coils comprising:

a position processor for generating an energy signal and open and close timer signals in response to a position signal representing a position of a valve actuator armature relative to open and close coils;

a current controller for generating a final current command signal and a normalized energy signal in response to said energy signal;

an event generator for generating event signals in response to said open and close timer signals and said normalized energy signal; and a supervision logic controller for generating initialization and transition signals in response to said final current command signal and said event signals, said initialization and transition signals defining current pulse magnitude and duration for soft seating of the armature on a seating surface of cores associated with the open and close coils.

2. The apparatus according to claim 1 wherein said position processor includes means for differentiating said position signal to obtain a speed signal representing a speed of the armature and means responsive to said position signal and said speed signal for generating said energy signal representing a total mechanical energy of the armature.

3. The apparatus according to claim 1 wherein said position processor includes means for normalizing said open and close timer signals utilizing one half of a natural transition time of the armature.

4. The apparatus according to claim 1 wherein said current controller includes means for normalizing said energy signal based upon a selected maximum potential energy to generate said normalized energy signal.

5. The apparatus according to claim 1 wherein said current controller includes a look-up table storing values of the maximum energy that can be injected into the armature for a plurality of values of current pulses, means for estimating a total energy loss based upon the position of the armature and command means responsive to a maximum energy value obtained from said look-up table and said total energy loss for generating said final current command signal.

6. The apparatus according to claim 5 wherein said command means generates said final current command signal by scaling and limiting.

7. The apparatus according to claim 1 wherein said event generator responds to said timer close signal to generate a cls_app signal when the armature is released from a valve open position and passes a middle point between the valve open position and a valve closed position, said supervisor logic controller being responsive to said cls_app signal to generate one of said initialization signals for starting a current pulse in the close coil.

8. The apparatus according to claim 7 wherein said event generator controller responds to said timer close signal to generate a cls_set signal for stopping said current pulse.

9. The apparatus according to claim 1 wherein said supervision logic controller generates said initialization and transition signals to define at least one higher magnitude current pulse to draw the armature toward one of the coils, followed by a predetermined period of no current pulse, followed by a lower magnitude holding current pulse.

10. The apparatus according to claim 9 wherein a magnitude of said holding current pulse is just sufficient to overcome friction present during seating of the valve.

11. The apparatus according to claim 1 wherein said current controller includes means for generating a difference signal representing a difference between a seating energy value and a full system energy value and adding said difference signal to said final current command signal.

12. A method for controlling an electromagnetic valve actuator having an armature positioned between open and close coils comprising the steps of:

a. generating a final current command signal in response to a position signal representing a position of a valve actuator armature relative to open and close coils;

b. generating a first signal in response to said final current command signal defining a higher magnitude current pulse of predetermined duration to draw the armature toward the one of the coils;

c. generating a second signal in response to said final current command signal defining a predetermined period of no current pulse; and d. generating a third signal in response to said final current command signal defining a lower magnitude holding current pulse for soft seating of the armature on a seating surface of a core associated with the one coil.

13. The method according to claim 12 wherein said step a. is repeated at least once after said step b. is performed.

14. The method according to claim 12 wherein the one coil is the close coil and the lower magnitude is just sufficient to overcome friction present during seating of the valve.

15. The method according to claim 12 wherein said step a. is performed by differentiating a position signal representing a position of the armature relative to the coils to obtain a speed signal representing a speed of the armature, obtaining a total mechanical energy of the armature from the position signal and the speed signal and generating the final current command signal based upon the total mechanical energy of the armature.

16. The method according to claim 12 wherein said step a. is performed by obtaining from a look-up table a value of a maximum energy that can be injected into the armature for an associated value of current pulse, estimating a total energy loss based upon the position of the armature and generating the final current command signal command based upon the maximum energy value and the total energy loss.

17. The method according to claim 11 wherein said step a. includes adding to the final current command signal a difference signal representing a difference between a seating energy value and a full system energy value signal.

* * * * *